US007484942B2

(12) United States Patent
Proust

(10) Patent No.: US 7,484,942 B2
(45) Date of Patent: Feb. 3, 2009

(54) PRIMING PUMP FOR A CIRCUIT SUBJECTING SAID PUMP TO AN OUTLET PRESSURE GREATER THAN AN INLET PRESSURE

(76) Inventor: Nathalie Proust, 30 rue de Saint Brice, 51100 Reims (FR)

( * ) Notice: Subject to any disclaimer, the term of this patent is extended or adjusted under 35 U.S.C. 154(b) by 685 days.

(21) Appl. No.: 10/926,325

(22) Filed: Aug. 26, 2004
(Under 37 CFR 1.47)

(65) Prior Publication Data

US 2006/0045778 A1 Mar. 2, 2006

(51) Int. Cl.
*F04B 45/06* (2006.01)

(52) U.S. Cl. ..... 417/478

(58) Field of Classification Search ..... 417/478, 417/557

See application file for complete search history.

(56) References Cited

U.S. PATENT DOCUMENTS 723,042 A * 3/1903 Schwerin ..... 417/478
1,352,306 A * 9/1920 Mott ..... 417/478
1,965,006 A * 7/1934 Scott ..... 417/478
3,009,459 A * 11/1961 Henning ..... 417/478
3,127,845 A * 4/1964 Voelcker ..... 417/478
3,204,857 A * 9/1965 Weller ..... 417/458
3,883,272 A * 5/1975 Puckett ..... 417/383
4,474,540 A * 10/1984 Bonastia et al. ..... 417/478
4,936,298 A * 6/1990 Nishina et al. ..... 128/205.13
5,970,935 A 10/1999 Harvey et al.

FOREIGN PATENT DOCUMENTS

FR 1 364 632 10/1964
FR 2 703 403 7/1994

* cited by examiner

*Primary Examiner*—Charles G Freay
(74) *Attorney, Agent, or Firm*—Dykema Gossett PLLC

(57) ABSTRACT

The invention provides a priming pump comprising a deformable envelope associated with an inlet endpiece and an outlet endpiece each fitted with a moving valve member, the endpieces being arranged in such a manner that when the valve members are in the closed position, the outlet endpiece presents a leakage rate that is greater than the leakage rate of the inlet endpiece.

3 Claims, 1 Drawing Sheet

PRIMING PUMP FOR A CIRCUIT SUBJECTING SAID PUMP TO AN OUTLET PRESSURE GREATER THAN AN INLET PRESSURE

The invention relates to a priming pump for a circuit subjecting said pump to an outlet pressure greater than an inlet pressure, intended in particular for mounting in parallel with a fuel circuit in certain vehicles, for example vehicles fitted with engines having a common injector manifold.

BACKGROUND OF THE INVENTION

In this type of configuration, shown in FIG. 1 which is a diagram of a fuel circuit, the fuel initially contained in a tank 1 passes through a filter 2, and is then drawn into an injector pump 3 by means of a feed line 4. The outlet from the injector pump 3 is connected to injectors 5 for feeding the cylinders of the engine, and excess fuel is returned to the tank 1 by means of a return line 6.

The return line 6 is at a pressure greater than the pressure that exists in the tank 1, while the feed line 4 is at a pressure that is lower than the pressure in the tank 1.

A priming pump 7 is disposed between the feed line 4 and the return line 6 of the injector pump 3 in order to re-prime it after running out of fuel or after taking action on the feed circuit. For this purpose, the priming pump 7 has inlet and outlet endpieces fitted with moving check valve members (not shown in the figure) so that when the priming pump is operated, fuel is transferred from the feed line 4 to the return line 6 (arrow 8) in order to force-feed the injector pump 3.

In a configuration with the priming pump in parallel as shown in FIG. 1, no fuel flows through the priming pump during normal operation of the engine, and as a result fuel stagnates permanently in the priming pump.

The valve members included in the inlet and outlet endpieces of the priming pump thus remain in the closed position during normal operation of the engine, and so the valve member for the inlet endpiece is subjected to suction from the feed line and the valve member for the outlet endpiece is subjected to pressure from the return line.

Unfortunately, the valve members in the endpieces are never perfectly seated against their seats, and each of them therefore presents a residual leakage rate. Depending on which one of the valve members presents the greater leakage rate during operation of the engine, the priming pump can be subjected either to excess pressure, in which case it will become slightly inflated, or else to suction, in which case it runs the risk of collapsing. This can be particularly troublesome. Since the pump is located in an environment that is very hot, it runs the risk of becoming progressively thermoformed in the position that it occupies while the engine is running.

Being thermoformed in the inflated position has no effect on the operation of the priming pump. It will still be able to perform its function whenever necessary. However, being thermoformed in the collapsed position makes the pump unusable. The invention seeks to avoid this situation.

OBJECTS AND SUMMARY OF THE INVENTION

Thus, the invention provides a priming pump including inlet and outlet endpieces fitted with moving valve members and which are arranged, according to the invention, in such a manner that when the valve members are in the closed position, the outlet endpiece has a leakage rate that is greater than the leakage rate of the inlet endpiece.

Thus, the greater leakage rate on the outlet side enables the pressure that exists at the outlet of the pump to become dominant in the priming pump. Since the outlet pressure is greater than atmospheric pressure, the priming pump is maintained under pressure, thus keeping its envelope in its inflated position and preventing it from collapsing under the effect of the suction that exists in the feed line to the injector pump.

In a particular aspect of the invention, each of the endpieces comprises a hollow body defining a cavity defined at one end by an end wall having an orifice through which a coupling opens out for connecting the priming pump to a circuit, and at the other end by a cover fitted thereto and having an orifice, the valve member being mounted inside the cavity so as to be pressed, in the closed position, against the orifice in the end wall of the hollow body in the inlet endpiece and against the orifice in the fitted cover in the outlet endpiece.

In an advantageous aspect of the invention, the hollow bodies, the covers, and the valve members are identical for the inlet and outlet endpieces, the valve members being mounted in opposite directions in the two endpieces.

Preferably, the orifices in the end walls of the hollow bodies are of a shape corresponding to the shape of the valve members so as to ensure closure with leakage at a low rate, while the orifices of the fitted covers are of a shape that does not correspond to the shape of the valve members so as to deliberately create leakage between a valve member and a fitted cover at a flow rate that is greater than the flow rate of leakage between a valve member and the end wall of a hollow body.

This disposition makes it simple to obtain asymmetry in the residual leakage rates between the endpieces.

BRIEF DESCRIPTION OF THE DRAWING

Other characteristics and advantages of the invention appear more clearly in the light of the following description of a particular, non-limiting embodiment of the invention. Reference is made to the accompanying figures, in which, in addition to FIG. 1, which is described above.

MORE DETAILED DESCRIPTION

Figure 1:
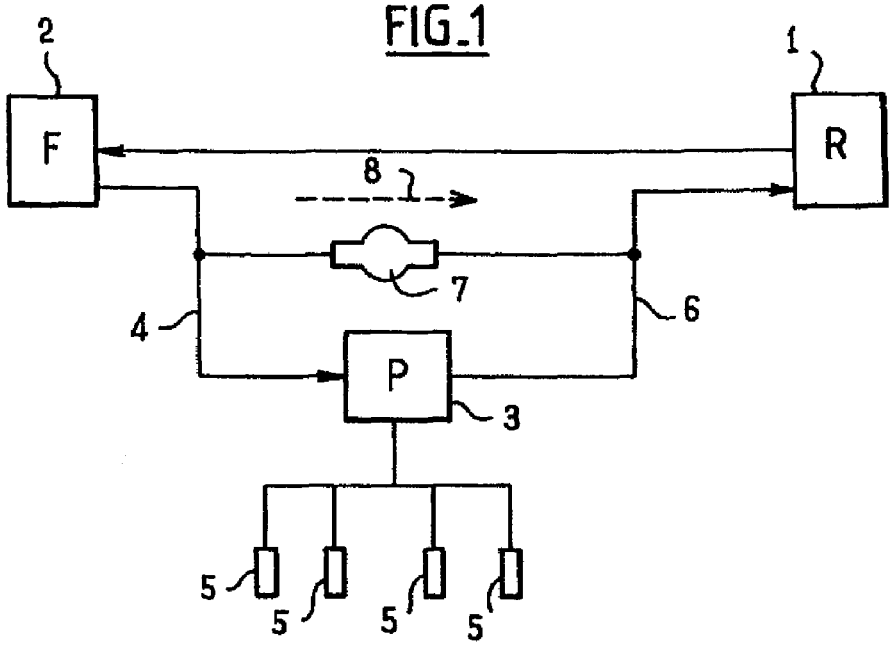
Figure 2:
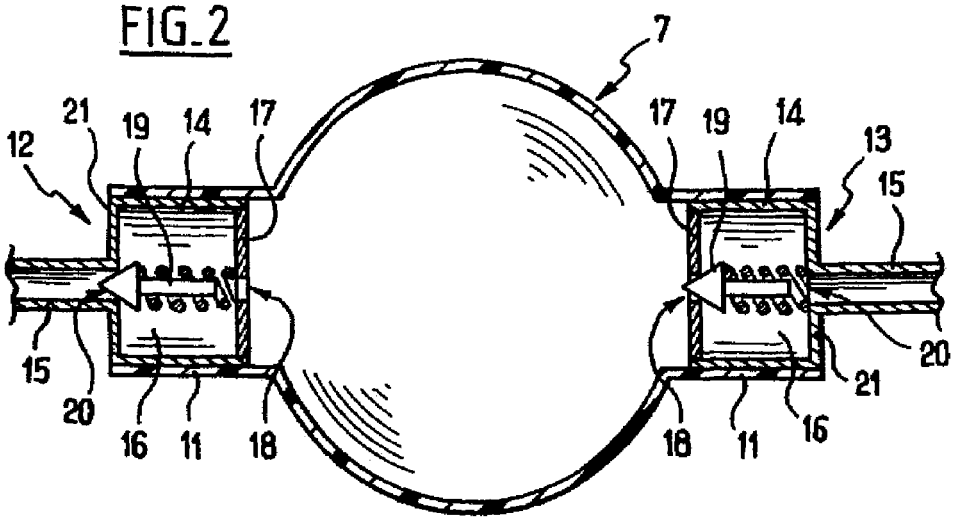
FIG. 2 is a diagrammatic section view of a priming pump of the invention.

With reference to FIG. 2 and in conventional manner, the priming pump 7 comprises an elastomer envelope having a central zone 10 of large diameter that is manually deformable, the central zone 10 being associated with coupling zones 11 which extend from opposite sides thereof and which contain directional endpieces, specifically an inlet endpiece 12 and an outlet endpiece 13.

The inlet endpiece 12 and the outlet endpiece 13 both comprise a respective hollow body 14 engaged in the corresponding coupling zone 11 of the envelope. The hollow bodies 14 are extended by respective couplings 15 for connecting the priming pump to the circuit, the coupling 15 opening out via an orifice 20 into one of the end walls 21 of the hollow body 14. The hollow bodies 14 form respective cavities 16 that are defined between the end walls 12, and respective covers 17 that are fitted thereto and that present respective orifices 18.

In each of the endpieces 12, 13, a valve member 19 is mounted to move in the cavity 16. It should be observed that the valve members 19 in the inlet and outlet endpieces 12 and 13 are not mounted symmetrically. The valve member 19 in the inlet endpiece 12 is urged by a spring against the orifice 20 in the end wall 21 of the hollow body 14 so as to close the inlet endpiece 12, while the valve member 19 of the outlet endpiece 13 bears against the orifice 18 in the fitted cover 17 in order to close the outlet endpiece 13. The orifices 18 and 20 thus form seats for the valve members 19.

Figure 3:
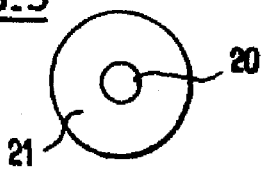
FIG. 3 is a diagrammatic view of the end walls of the hollow bodies in each of the endpieces of the priming pump.

With reference to FIG. 3, the orifice 20 in the end wall 21 of the hollow bodies 14 are perfectly circular. The valve member 19 of the inlet endpiece 12, possesses a conical bearing surface, and thus fits well when pressed against the orifice 20. Leakage between the valve member 19 and the orifice 20 is thus zero or very small.

Figure 4:
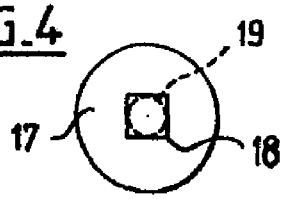
FIG. 4 is a diagrammatic view of the fitted cover on each of the endpieces of the priming pump.

With reference to FIG. 4, the orifice 18 in the cover 17 has an outline that is not circular, for example in this case it is square with rounded corners. The conical bearing surface of the valve member 19 in the outlet endpiece 13 therefore does not fit well when pressed against the orifice 18 (the trace of the valve member pressing against the orifice 18 is represented by dashed lines), thereby giving rise, by construction, to a leakage flow at a rate that is small, and thus that is greater than the leakage rate through the inlet endpiece 12.

As a result, inlet and outlet endpieces are obtained that are made using exactly the same parts, but that present greater or smaller leakage rates depending on the direction in which the respective valve members are mounted.

The leakage rate difference of the invention thus makes it possible to maintain the envelope of the priming pump 7 under pressure whenever the inlet pressure is lower than the outlet pressure. The envelope of the priming pump therefore does not collapse while the engine is in operation, thereby ensuring that it does not become thermoformed under the effect of heat from the engine.

The leakage rates nevertheless remain quite small so as to avoid penalizing the operation of the priming pump when it is actuated.

What is claimed is:

1. A priming pump for a circuit subjecting said pump to an outlet pressure greater than an inlet pressure, the pump comprising: a deformable envelope associated with an inlet endpiece and an outlet endpiece, each fitted with a moving valve member, wherein the endpieces are arranged in such a manner that when the valve members are in the closed position, the outlet endpiece presents a leakage rate that is greater than the leakage rate of the inlet endpiece, wherein each of the endpieces comprises a hollow body defining a cavity defined at one end by an end wall including an orifice into which there opens out a coupling for connecting the priming pump to a circuit, and at its other end by a fitted cover including an orifice, the valve member of the inlet endpiece being mounted in the cavity in the inlet endpiece so as to be pressed against the orifice in the end wall of the hollow body, and the valve member of the outlet endpiece being mounted in the outlet endpiece so as to be pressed against the orifice in the fitted cover, wherein the hollow bodies, the fitted covers, and the valve members are identical for the inlet and outlet endpieces, and wherein the orifices in the end walls of the hollow bodies are of a shape corresponding to the shape of the valve members, whereas the orifices in the fitted covers are of a shape that does not correspond to the shape of the valve members.

2. A priming pump according to claim 1, wherein said circuit comprises a circuit for conveying liquid.

3. A priming pump according to claim 1, wherein said circuit comprises a fuel circuit.

* * * * *